US009831586B2

(12) United States Patent
Uezono

(10) Patent No.: US 9,831,586 B2
(45) Date of Patent: Nov. 28, 2017

(54) FEMALE TERMINAL FITTING WITH MAIN SPRING PIECE AND REINFORCED AUXILIARY SPRING PIECE

(71) Applicant: Sumitomo Wiring Systems, Ltd., Yokkaichi, Mie (JP)

(72) Inventor: Katsuya Uezono, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/227,133

(22) Filed: Aug. 3, 2016

(65) Prior Publication Data

US 2017/0054237 A1 Feb. 23, 2017

(30) Foreign Application Priority Data

Aug. 19, 2015 (JP) ..... 2015-161664

(51) Int. Cl.

| | |
|---|---|
| ***H01R 9/24*** | (2006.01) |
| ***H01R 13/11*** | (2006.01) |
| ***H01R 11/28*** | (2006.01) |
| ***H01R 13/115*** | (2006.01) |

(52) U.S. Cl.

CPC ..... *H01R 13/113* (2013.01); *H01R 11/282* (2013.01); *H01R 13/114* (2013.01); *H01R 13/115* (2013.01)

(58) Field of Classification Search

CPC ..... H01R 9/24; H01R 11/22; H01R 11/282; H01R 13/15; H01R 13/187; H01R 13/703; H01R 13/113–13/115

USPC ..... 439/852, 842, 889, 862

See application file for complete search history.

(56) References Cited

U.S. PATENT DOCUMENTS

| | | | | |
|---|---|---|---|---|
| 5,941,741 | A | 8/1999 | Dobbelaere et al. | |
| 6,126,495 | A * | 10/2000 | Lolic | H01R 13/18 439/752.5 |
| 6,520,811 | B2 * | 2/2003 | Mitani | H01R 13/113 439/843 |
| 8,845,362 | B2 * | 9/2014 | Chikusa | H01R 13/6275 439/595 |

(Continued)

FOREIGN PATENT DOCUMENTS

| | | |
|---|---|---|
| DE | 102014006875 A1 | 12/2014 |
| JP | 2006-100233 | 4/2006 |

OTHER PUBLICATIONS

German Office Action dated Jul. 10, 2017.

*Primary Examiner* — Chandrika Prasad

(74) *Attorney, Agent, or Firm* — Gerald E. Hespos; Michael J. Porco; Matthew T. Hespos

(57) ABSTRACT

A female terminal fitting (F) includes a rectangular tubular main body (10). The main body (10) has a rear base plate (14). Left and right side plates (15) are connected at substantially right angles to opposite left and right sides of the rear base plate (14). A main spring piece (20) is accommodated in the main body (10) and is configured to resiliently contact a tab (T) of a mating terminal (M) inserted into the main body (10). An auxiliary spring piece (23) is cantilevered from the rear base plate (14), is accommodated in the main body (10) and is configured to apply a resilient pressing force toward the tab (T) to the main spring piece (20). A reinforcing portion (28) is formed by striking a range from a base end part (23R) of the auxiliary spring piece 23 to the rear base plate (14).

16 Claims, 6 Drawing Sheets

(56) References Cited

U.S. PATENT DOCUMENTS

| | | | | |
|---|---|---|---|---|
| 8,858,259 | B2 * | 10/2014 | Chikusa | H01R 13/6271 439/595 |
| 8,974,256 | B2 * | 3/2015 | Okano | H01R 13/11 439/852 |
| 2006/0068650 | A1 | 3/2006 | Shimizu | |
| 2013/0288548 | A1 | 10/2013 | Amano et al. | |

* cited by examiner

FEMALE TERMINAL FITTING WITH MAIN SPRING PIECE AND REINFORCED AUXILIARY SPRING PIECE

BACKGROUND

1. Field of the Invention

The invention relates to a female terminal fitting.

2. Description of Related Art

Japanese Unexamined Patent Publication No. 2006-100233 discloses a female terminal fitting with a rectangular tube. A main spring piece is cantilevered in the rectangular tube and is configured to resiliently contact a tab of a male terminal fitting. An auxiliary spring piece also is in the rectangular tube as a reinforcing means for pressing the main spring piece toward the tab. A bulge is formed by partially striking a base end part of the auxiliary spring piece. The bulge enhances the rigidity of the auxiliary spring piece and increases a contact pressure between the main spring piece and the tab by improving a reinforcing function of the auxiliary spring piece.

A formation area of a reinforcing portion is limited within the range of the auxiliary spring piece in the above-described female terminal fitting. Thus, the rigidity of a boundary between the base end part of the auxiliary spring piece and a bottom wall supporting this base end part is not enhanced. Accordingly, the reinforcing function by the auxiliary spring piece is not sufficiently exhibited and improvements are desired.

The invention was completed based on the above situation and aims to improve the reliability of a reinforcing function by an auxiliary spring piece.

SUMMARY

The invention relates to a female terminal fitting with a main body and a base plate forming part of the main body. A main spring piece is accommodated at least partly in the main body and is configured to resiliently contact a tab of a mating terminal at least partly inserted into the main body. An auxiliary spring piece is cantilevered from the base plate and is accommodated at least partly in the main body. The auxiliary spring piece is configured to apply a resilient pressing force toward the tab to the main spring piece. At least one reinforcing portion is formed by striking the auxiliary spring piece.

The reinforcing portion may be formed by striking a range from a base end part of the auxiliary spring piece to the base plate.

The main body may be a rectangular or polygonal tube.

The female terminal fitting may further comprise one or more side plates forming part of the main body and connected at an angle, preferably substantially at a right angle to the base plate.

The main spring piece may be accommodated in the main body.

The female terminal fitting may be configured so that the auxiliary spring piece is shaped to be gradually wider from an extending end toward a base end that is connected to the base plate. This configuration enhances the reinforcing function by the auxiliary spring piece.

A contact area of the auxiliary spring piece with the main spring piece may be shaped or molded to be thin. Accordingly, a large deflection margin of the main spring piece can be ensured in a limited accommodation space of the main body.

An extending end part of the main spring piece may have a curved surface that is convex inward of the main body to form a contact portion, and an area of the extending end part of the main spring piece adjacent to the contact portion may define a pressing portion configured to contact an auxiliary spring piece.

The auxiliary spring piece may have a side view shape with at least two curve areas having different curvature directions connected one after the other A projecting distance of the reinforcing portion may be substantially constant over the entire area and/or a width of the reinforcing portion may be larger than half a maximum width of the auxiliary spring piece.

Since the reinforcing portion is continuously formed from the base end part of the auxiliary spring piece to the base plate, a boundary portion between the base end part of the auxiliary spring piece and the base plate also is reinforced. Thus, the reliability of a reinforcing function by the auxiliary spring piece is excellent.

These and other objects, features and advantages of the invention will become more apparent upon reading the following detailed description of preferred embodiments and accompanying drawings. It should be understood that even though embodiments are described separately, single features may be combined to additional embodiments.

DETAILED DESCRIPTION

Hereinafter, one specific embodiment of the present invention is described with reference to FIGS. 1 to 6. A female terminal fitting F of this embodiment substantially is formed into a shape long and narrow in a front-back direction by applying cutting, bending, embossing and/or striking and the like to a conductive (particularly metal) plate material punched or cut out into a specified shape. Note that, in the following description, a connecting side with a mating terminal fitting M (specifically a left side in FIGS. 1, 2, 4 and 5) is defined as a front side concerning the front-back direction. Further, lateral sides (specifically upper and lower sides shown in FIGS. 1 to 3) are defined as upper and lower sides concerning a vertical direction.

Figure 1:
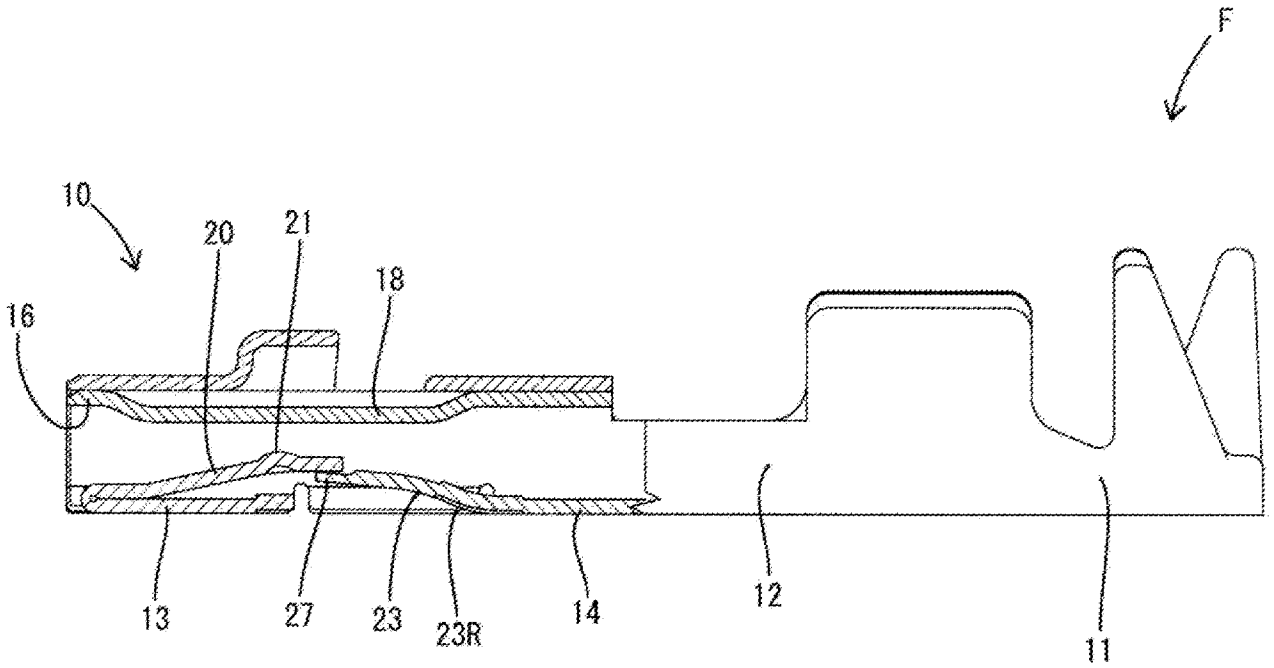
FIG. 1 is a side view partly in section of a female terminal fitting of one embodiment.
Figure 2:
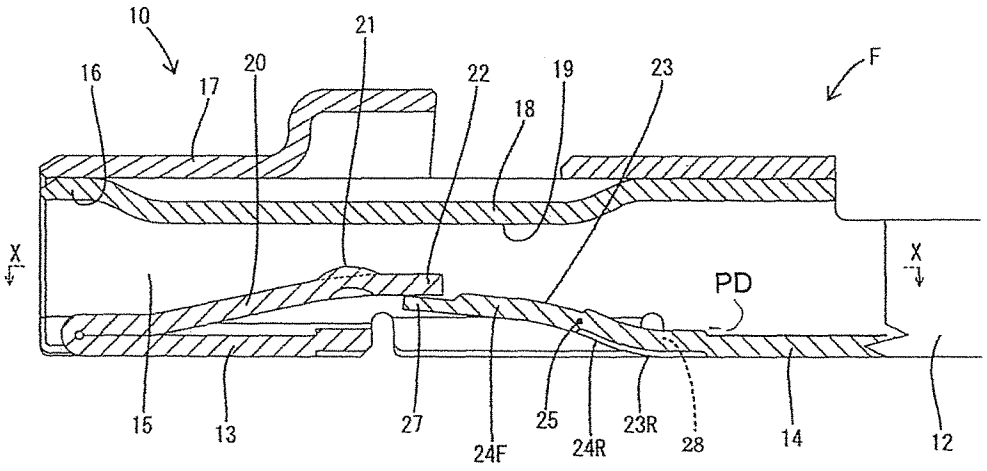
FIG. 2 is a partial enlarged view of FIG. 1.
Figure 3:
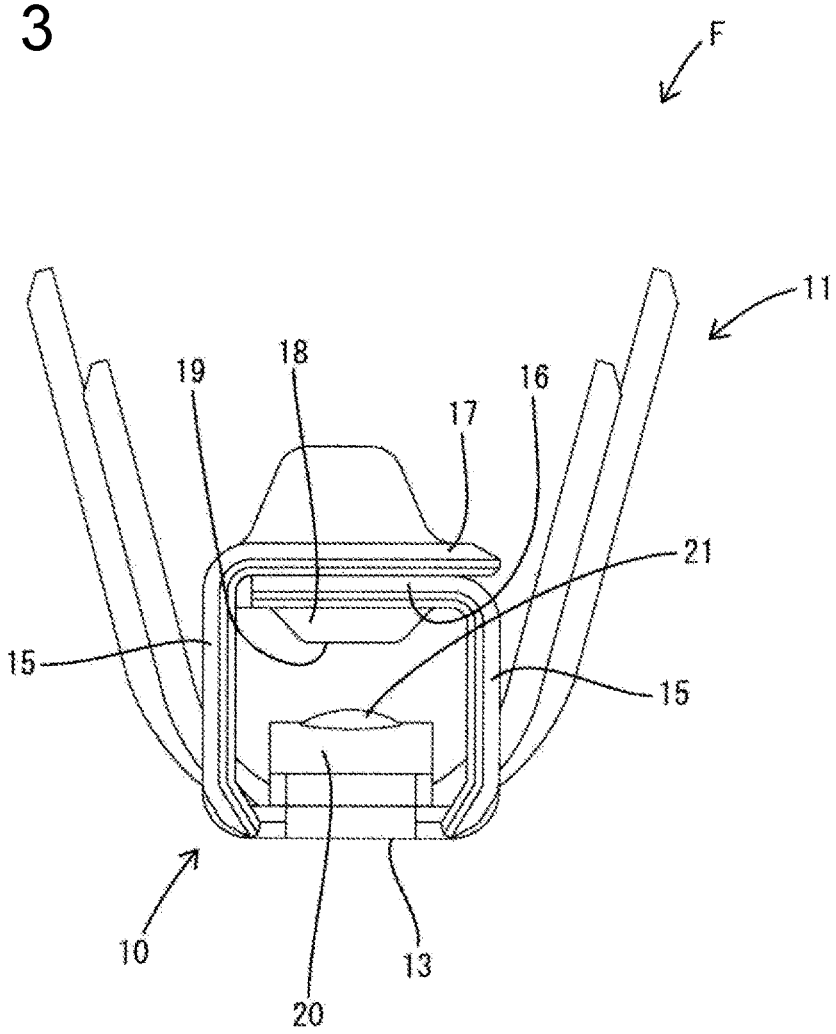
FIG. 3 is a front view of the female terminal fitting.

As shown in FIG. 1, the female terminal fitting F includes a main body 10 substantially in the form of a rectangular or polygonal tube, a wire connecting portion comprising at least one crimping portion 11 substantially in the form of an open barrel to be electrically conductively fixed or connected to a wire (not shown) and a coupling portion 12 linking the rear end of the main body 10 and the front end of the crimping portion 11. As shown in FIGS. 2 and 3, the main body 10 includes a front base plate 13, a rear base plate 14, left and right side plates 15, an inner plate 16 and an outer plate 17. The front base plate 13 and the rear base plate 14 are arranged substantially horizontally and are at substantially the same height while being spaced apart in the front-back direction. The front base plate 13 is located on or near a front end part of the main body 10 and/or the rear base plate 14 is located on or near a rear end part of the main body 10. The coupling portion 12 is connected to the rear end of the rear base plate 14.

The left and right side plates 15 stand up or project substantially perpendicularly from opposite left and right sides of the front base plate 13 and opposite left and right sides of the rear base plate 14. The side plates 15 are formed over the entire length of the main body 10. The inner plate 16 extends substantially parallel to both base plates 13, 14 from the upper or distal end edge of one side plate 15. The inner plate 16 is formed with a receiving plate portion 18 by striking a part thereof down (inward of the main body 10). The receiving plate portion 18 has a receiving surface 19 substantially parallel to the base plates 13, 14. The outer plate portion 17 extends substantially parallel to the base plates 13, 14 from the upper or distal end edge of the other side plate 15 and is placed at least partly over the outer surface of the inner plate 16.

Figure 6:
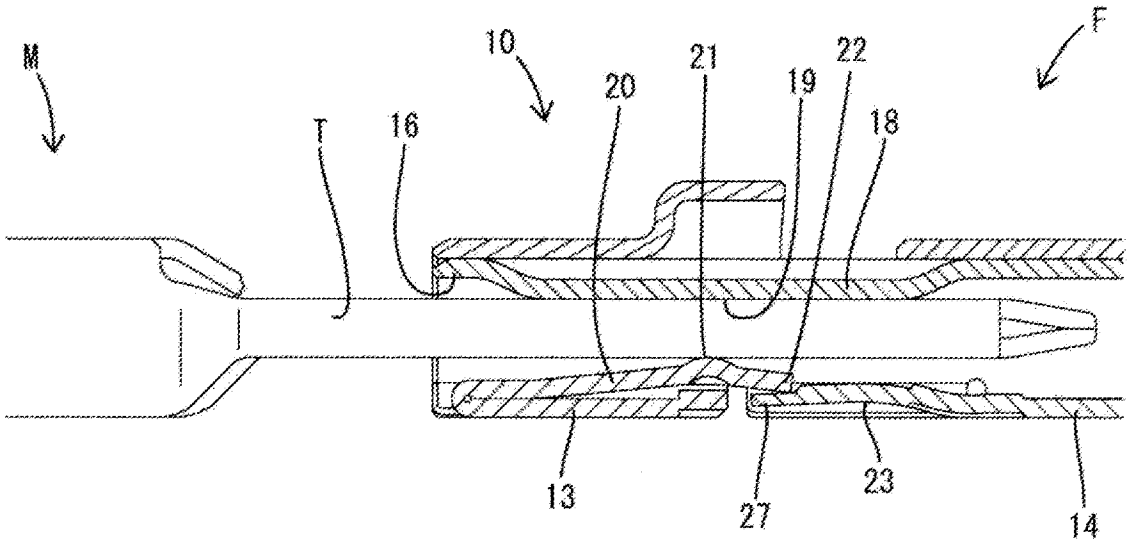
FIG. 6 is a partial section showing a state where the female terminal fitting and a mating terminal are connected.

The female terminal fitting F includes a substantially plate-like main spring piece 20. As shown in FIG. 6, the main spring piece 20 functions as a means for connecting the female terminal fitting F and a mating terminal M at a specified contact pressure by being pressed against a tab T of the mating terminal M inserted into the main body 10 from the front by resiliently sandwiching the tab T of the mating terminal M inserted into the main body 10 from the front between the receiving surface 19 (receiving plate portion 18) and the main spring piece 20. As shown in FIG. 2, the main spring piece 20 is closely folded from the front end edge of the front base plate 13 to cantilever back in the main body portion 10. The main spring piece 20 is inclined to gradually increase a vertical spacing between the front base plate 13 and the main spring piece 20 toward the back (i.e. gradually narrow a spacing between the receiving surface 19 and the main spring piece 20 toward the back and/or gradually project more inward into the main body 10).

Figure 4:
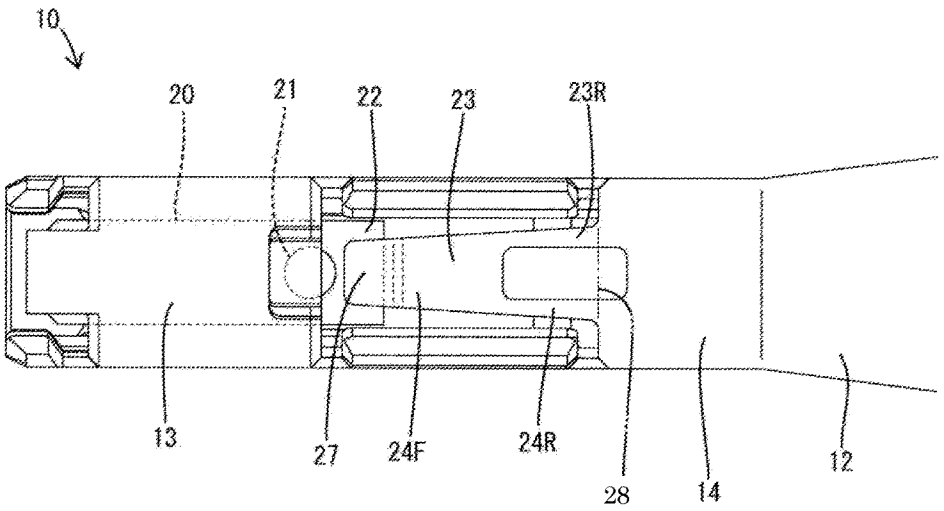
FIG. 4 is a bottom view of the female terminal fitting.
Figure 5:
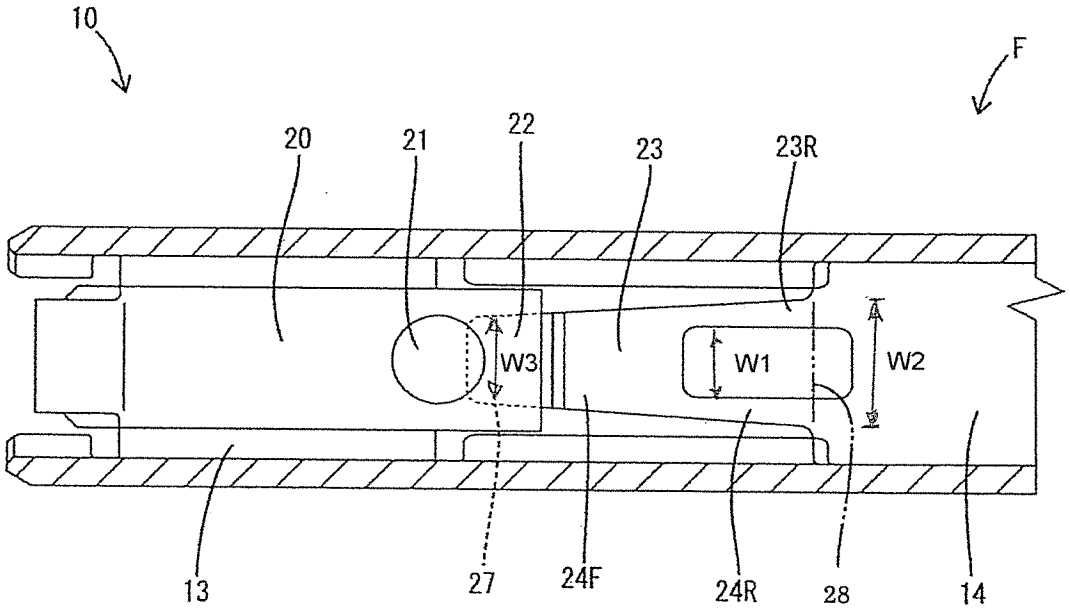
FIG. 5 is a section along X-X of FIG. 2.

As shown in FIGS. 4 and 5, a width of the main spring piece 20 is substantially constant over the entire length thereof. An extending end part (rear end part) of the main spring piece 20 is struck to have a curved surface convex upward or inward of the main body 10 (toward the receiving surface 19), thereby forming a contact portion 21. The contact portion 21 contacts the lower surface of the tab T. An area of the extending end part of the main spring piece 20 behind the contact portion 21 serves as a pressing portion 22 configured to contact an auxiliary spring piece 23.

The female terminal fitting F includes the auxiliary spring piece 23. The auxiliary spring piece 23 functions as a reinforcing means for increasing a contact pressure between the main spring piece 20 and the tab T. As shown in FIG. 2, the auxiliary spring piece 23 is cantilevered obliquely up toward the front from the front end edge of the rear base plate 14. That is, the main spring piece 20 and the auxiliary spring piece 23 extend in opposite directions along the front-back direction.

As shown in FIGS. 4 and 5, the auxiliary spring piece 23 has such a plan view shape as to be gradually wider from the extending end (front end) thereof toward the base or rear end (trapezoidal shape). A width of the auxiliary spring piece 23 is largest at the rear end thereof (i.e. boundary portion 26 with the rear base plate 14). Further, the width of the auxiliary spring piece 23 is smallest at the extending front end thereof. The maximum width of the auxiliary spring piece 23 is substantially equal to the width of the main spring piece 20. Thus, the minimum width of the auxiliary spring piece 23 is smaller than the width of the main spring piece 20.

As shown in FIG. 2, the auxiliary spring piece 23 has a side view shape with two curve areas 24F, 24R having different curvature directions connected one after the other. Specifically, the front curve area 24A is curved to bulge up or in (in a direction toward the receiving surface 19). The rear curve area 24R is curved to bulge down or out (in a direction away from the receiving surface 19). A part where these front and rear two curve areas 24F, 24R are connected serves as an inflection point 25. That is, the curvature direction (bulging direction) of the auxiliary spring piece 23 in a side view changes at the inflection point 25.

An extending end part of the auxiliary spring piece 23 serves as a pressure receiving portion 27 at least partly located to slip under or outside the pressing portion 22 of the main spring piece 20. The pressing portion 22 and the pressure receiving portion 27 are located behind the contact portion 21 (extending end side of the main spring piece 20). This pressure receiving portion 27 is made thinner or having a smaller dimension in thickness direction) than the other area or entire area (base end side) behind the pressure receiving portion 27 by recessing the upper surface (surface in contact with the main spring piece 20) thereof in a substantially in a stepped manner. Thus, a vertical dimension from the upper end of the contact portion 21 to the lower surface of the pressure receiving portion 27 is smaller as compared to the case where the pressure receiving portion 27 is not thinned.

To improve the reinforcing function of the auxiliary spring piece 23, the auxiliary spring piece 23 and the rear base plate 14 are formed with a reinforcing portion 28 for enhancing the rigidity thereof. The reinforcing portion 28 is formed by striking or embossing the auxiliary spring piece 23 up or in. An upward or inward projecting distance PD by striking is substantially constant over the entire area of the reinforcing portion 28. The reinforcing portion 28 has a substantially rectangular plan view shape long in the front-back direction. Thus, a width W1 of the reinforcing portion 28 is constant over the entire length in the front-back direction. The width W1 of the reinforcing portion 28 is slightly larger than half the maximum width W2 of the auxiliary spring piece 23. Further, the width W1 of the reinforcing portion 28 is slightly smaller than the minimum width W3 of the auxiliary spring piece 23.

In the front-back direction (direction parallel to the extending direction of the auxiliary spring piece 23), a formation range of the reinforcing portion 28 is a continuous range from a base end part 23R (rear end part) of the auxiliary spring piece 23 to the front end part (area connected to the auxiliary spring piece 23) of the rear base plate 14. That is, a formation area of the reinforcing portion 28 includes the auxiliary spring piece 23 and the boundary 26 with the rear base plate 14 supporting the auxiliary spring piece 23. Likewise, in the front-back direction, a formation range of the reinforcing portion 28 on the auxiliary spring piece 23 is wider than that of the reinforcing portion 28 on the base plate. Likewise, in the front-back direction, the formation range of the reinforcing portion 28 is only an area closer to the base end side than (behind) the inflection point 25 of the auxiliary spring piece 23. That is, the reinforcing portion 28 is not formed on a front side (extending end side) before the inflection point 25.

When being at least partly inserted into the main body portion 10, the tab T resiliently deflects the main spring piece 20 down or out. Thus, the tab T is resiliently contacted by the main spring piece 20 by being sandwiched between the contact portion 21 and the receiving surface 19 by a resilient restoring force of the main spring piece 20. At this time, the main spring piece 20 resiliently displaced down or out by the tab T presses the pressure receiving portion 27 of the auxiliary spring piece 23 by the pressing portion 22. Therefore the auxiliary spring piece 23 is also resiliently deflected down or out together with the main spring piece 20. Then, a resilient reaction force resulting from the resilient restoring force of the auxiliary spring piece 23 acts on the pressing portion 22 from the pressure receiving portion 27. Thus, a large resilient force, which is the sum of the resilient restoring force of the main spring piece 20 and that of the auxiliary spring piece 23, is applied to the tab T. In this way, a sufficiently large contact pressure is ensured between the contact portion 21 of the main spring piece 20 and the tab T.

The female terminal fitting F of this embodiment includes the main body portion 10 substantially in the form of a rectangular tube, the rear base plate 14 forming part of the main body 10 and the left and right side plates 15 forming part of the main body 10 and connected at substantially right angles to the opposite left and right sides of the base plate. The main spring piece 20 configured to resiliently contact the tab T of the mating terminal M inserted into the main body 10 is accommodated in the main body 10. Similarly, the auxiliary spring piece 23 cantilevered from the rear base plate 14 is accommodated in the main body 10. The auxiliary spring piece 23 exhibits the reinforcing function of increasing the contact pressure between the main spring piece 20 and the tab T by applying a resilient pressing force toward the tab T to the main spring piece 20.

To improve this reinforcing function, the auxiliary spring piece 23 is formed with the reinforcing portion 28 formed by striking or embossing the auxiliary spring piece 23 in the range from the base end part 23R of the auxiliary spring piece 23 to the rear base plate 14. Since the reinforcing portion 28 is formed continuously from the base end part 23R of the auxiliary spring piece 23 to the rear base plate 14, the boundary 26 between the base end part 23R of the auxiliary spring piece 23 and the rear base plate 14 also is reinforced. Since this boundary 26 is at a long distance from a contact position (pressure receiving portion 27) of the auxiliary spring piece 23 with the main spring piece 20, it is a part whose deflection amount (stress) is possibly largest when the auxiliary spring piece 23 is resiliently deflected. The rigidity of this boundary 26 is enhanced by the reinforcing portion 28 in this embodiment. Thus, a stress becomes larger when the resilient deflection amount is the same, and the resilient pressing force applied from the auxiliary spring piece 23 to the main spring piece 20 accordingly becomes larger. Thus, the reliability of the reinforcing function by the auxiliary spring piece 23 is excellent.

Further, the auxiliary spring piece 23 is shaped to be gradually wider from the extending end toward the base end side connected to the rear base plate portion 14. According to this configuration, the side of the base end part 23R formed with the reinforcing portion 28 is widened. Therefore, the reinforcing function by the auxiliary spring piece 23 is further enhanced. Further, since the contact area (pressure receiving portion 27) of the auxiliary spring piece 23 with the main spring piece 20 is molded or shaped to be thin, the vertical dimension from the upper end of the contact portion 21 to the lower surface of the pressure receiving portion 27 is smaller as compared to the case where the pressure receiving portion 27 is not thinned. In this way, a sufficient deflection margin of the main spring piece 20 can be ensured in a limited accommodation space in the main body 10.

The invention is not limited to the above described and illustrated embodiment. For example, the following embodiments are also included in the technical scope of the present invention.

Although the main spring is cantilevered back in the above embodiment, it may extend forward in a cantilever manner.

Although the auxiliary spring piece is cantilevered forward in the above embodiment, it may extend backward in a cantilever manner.

Although the main spring piece and the auxiliary spring piece extend in the substantially opposite or intersecting directions along the front-back direction in the above embodiment, the main spring piece and the auxiliary spring piece may extend in the substantially same direction along the front-back direction.

Although the auxiliary spring piece has such a plan view shape as to be gradually wider from the extending end toward the base end side in the above embodiment, it may be shaped to be gradually narrower from the extending end toward the base end side or to have the same width from the extending end toward the base end side.

Although the auxiliary spring piece has such a side view shape that the two curve areas having different curvature directions are connected in the above embodiment, the side view shape of the auxiliary spring piece may be defined only by a curve area whose curvature direction does not change.

Although the contact position of the main spring piece with the auxiliary spring piece is set closer to the extending end side than the contact portion in the above embodiment, it may be closer to the base end side than the contact portion.

Although the maximum width of the auxiliary spring piece is substantially equal to the width of the main spring piece in the above embodiment, it may be larger or smaller than the width of the main spring piece.

Although the minimum width of the auxiliary spring piece is smaller than the width of the main spring piece in the above embodiment, it may be larger than or equal to the width of the main spring piece.

Although the width of the reinforcing portion is substantially constant over the entire length in the extending direction of the auxiliary spring piece in the above embodiment, it may be partially different in the extending direction of the auxiliary spring piece or may be gradually wider or narrower in the extending direction.

Although the width of the reinforcing portion is slightly larger than half the maximum width of the auxiliary spring piece in the above embodiment, it may be equal to or smaller than half the maximum width of the auxiliary spring piece.

Although the width of the reinforcing portion is slightly smaller than the minimum width of the auxiliary spring piece in the above embodiment, it may be equal to or larger than the minimum width of the auxiliary spring piece.

Although the formation range of the reinforcing portion in the extending direction of the auxiliary spring piece is only the area closer to the base end side than the inflection point at which the curvature direction (bulging direction) changes in the side view of the auxiliary spring piece in the above embodiment, it may include an area closer to the extending end side than the inflection point.

Although the formation range of the reinforcing portion on the auxiliary spring piece is wider than the formation range of the reinforcing portion on the base plate portion in the extending direction of the auxiliary spring piece in the above embodiment, it may be equal to or narrower than the formation range of the reinforcing portion on the base plate portion.

Although the surface of the auxiliary spring piece to be held in contact with the main spring piece is recessed as the means for thinning the contact area (pressure receiving portion) of the auxiliary spring piece with the main spring piece in the above embodiment, a surface not to be held in contact with the main spring piece may be, conversely, recessed.

Although the contact area (pressure receiving portion) of the auxiliary spring piece with the main spring piece is thinned in the above embodiment, the auxiliary spring piece may have the same plate thickness over the entire area without thinning the contact area of the auxiliary spring piece with the main spring piece.

LIST OF REFERENCE SIGNS

F . . . female terminal fitting
M . . . mating terminal
T . . . tab
10 . . . main body
14 . . . rear base plate
15 . . . side plate
20 . . . main spring piece
23 . . . auxiliary spring piece
23R . . . base end part of auxiliary spring piece
27 . . . pressure receiving portion (contact area)
28 . . . reinforcing portion

What is claimed is:

1. A female terminal fitting, comprising:
a tubular main body having opposite front and rear ends spaced apart along a longitudinal direction;
a base plate forming a part of the main body;
a main spring piece at least partly accommodated in the main body and configured to resiliently come into contact with a tab of a mating terminal at least partly inserted into the main body;
an auxiliary spring piece cantilevered forward from the base plate and at least partly accommodated in the main body, the auxiliary spring piece being configured to apply a resilient pressing force to the main spring piece in a direction toward the tab; and
at least one reinforcing embossment extending continuously from the base plate to the auxiliary spring piece.

2. The female terminal fitting of claim 1, wherein the main body is a rectangular or polygonal tube.

3. The female terminal fitting of claim 2, further comprising side plates forming part of the main body and connected at substantially right angles to opposite left and right sides of the base plate.

4. The female terminal fitting of claim 2, wherein the main spring piece is accommodated in the main body.

5. The female terminal fitting of claim 1, wherein the auxiliary spring piece has a width extending transverse to the longitudinal direction, the auxiliary spring piece being shaped so that the width becomes gradually greater from an extending end toward a base end that is connected to the base plate.

6. The female terminal fitting of claim 1, wherein the auxiliary spring piece has a width extending transverse to the longitudinal direction and a thickness transverse to both the longitudinal direction and the width, a contact area being defined at a forward end of the auxiliary spring piece, the contact area being disposed for contacting the main spring piece, the thickness of the auxiliary spring piece at the contact area being less than the thickness of the auxiliary spring piece at locations between the contact area and the base plate.

7. The female terminal fitting of claim 1, wherein an extending end part of the main spring piece is shaped to substantially have a curved surface convex in a direction away from the base plate of the main body thereby forming a contact portion, wherein an extending end part of the main spring piece adjacent to the contact portion defines a pressing portion configured to come into contact with the auxiliary spring piece.

8. The female terminal fitting of claim 1, wherein the auxiliary spring piece has a side view shape with at least two curve areas having different curvature directions connected one after the other.

9. The female terminal fitting of claim 1, wherein a projecting distance of the reinforcing embossment is substantially constant over all of the reinforcing embossment.

10. The female terminal fitting of claim 1, wherein the reinforcing embossment and the auxiliary spring piece have widths extending parallel to one another and transverse to the longitudinal direction, the width of the reinforcing embossment being greater than one-half of the width of the auxiliary spring piece.

11. The female terminal fitting of claim 1, wherein the main spring piece is cantilevered rearward from the front end of the tubular main body.

12. A female terminal fitting, comprising:
a rectangular tubular main body having opposite front and rear ends spaced apart along a longitudinal direction;
a base plate forming part of the main body;
opposed side walls extending substantially perpendicularly up from the base plate and spaced from one another in a width direction of the rectangular tubular main body;
a top wall extending between the side walls and opposed to the base plate;
a main spring piece cantilevered rearward from a location on the base plate substantially adjacent the front end of the main body and accommodated in the main body, the main spring piece being resiliently deflectable toward the base plate configured to resiliently contact a tab of a mating terminal inserted into the main body between the main spring piece and the top wall;
an auxiliary spring piece cantilevered forward from the base plate and at least partly accommodated in the main body, the auxiliary spring piece being on a side of the main spring piece opposite the top wall configured to apply a resilient pressing force to the main spring piece in a direction toward the top wall, the auxiliary spring piece being gradually wider at positions farther from the front end of the rectangular tubular main body; and
at least one reinforcing embossment extending continuously from the base plate to the auxiliary spring piece.

13. The female terminal fitting of claim 12, wherein the auxiliary spring piece has a contact area at a forward end of the auxiliary spring piece, the contact area being disposed for contacting a surface of the main spring piece opposite the top wall and at an end of the main spring piece opposite the front end, the auxiliary spring piece having a thickness transverse to both the longitudinal direction and the width direction, the thickness of the auxiliary spring piece at the contact area being less than the thickness of the auxiliary spring piece at locations between the contact area and the base plate.

14. The female terminal fitting of claim 12, wherein an extending end part of the main spring piece is curved convexly toward the top wall to form a contact portion, a part of the main spring piece rearward of the contact portion defining a pressing portion that is disposed and configured to contact the auxiliary spring piece.

15. The female terminal fitting of claim 12, wherein the reinforcing embossment has a width extending parallel to the width of the rectangular tubular main body, the width of the reinforcing embossment being substantially uniform from a front end of the reinforcing embossment to a rear end thereof.

16. The female terminal fitting of claim 15, wherein a projecting distance of the reinforcing embossment is substantially constant over all of the reinforcing embossment.

* * * * *